US008242071B2

(12) United States Patent
Henault et al.

(10) Patent No.: US 8,242,071 B2
(45) Date of Patent: Aug. 14, 2012

(54) PROCESS FOR PREPARING FABRIC SOFTENER COMPOSITIONS

(75) Inventors: Benoit Henault, Waterloo (BE); Christel Simon, Lobbes (BE); Stephane Ugazio, Soignies (BE)

(73) Assignee: Dow Corning Corporation, Midland, MI (US)

( * ) Notice: Subject to any disclaimer, the term of this patent is extended or adjusted under 35 U.S.C. 154(b) by 456 days.

(21) Appl. No.: 12/444,219

(22) PCT Filed: Oct. 4, 2007

(86) PCT No.: PCT/EP2007/060552

§ 371 (c)(1),
(2), (4) Date: Dec. 18, 2009

(87) PCT Pub. No.: WO2008/040785

PCT Pub. Date: Apr. 10, 2008

(65) Prior Publication Data

US 2010/0184634 A1 Jul. 22, 2010

Related U.S. Application Data

(60) Provisional application No. 60/850,224, filed on Oct. 6, 2006.

(51) Int. Cl.
*C11D 1/835* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | | |
|---|---|---|---|---|
| 3,915,867 | A | 10/1975 | Kang et al. | |
| 4,137,180 | A | 1/1979 | Naik et al. | |
| 4,426,299 | A | 1/1984 | Verbruggen | |
| 4,806,255 | A | 2/1989 | Konig et al. | |
| 4,855,072 | A | 8/1989 | Trinh et al. | |
| 5,035,832 | A | 7/1991 | Takamura et al. | |
| 6,251,850 | B1 | 6/2001 | Clarke et al. | |
| 7,026,277 | B2 | 4/2006 | Ferguson et al. | |
| 2001/0006937 | A1 | 7/2001 | Charlton et al. | |
| 2004/0014627 | A1 * | 1/2004 | Adams et al. | 510/329 |
| 2004/0014632 | A1 * | 1/2004 | Howard et al. | 510/515 |
| 2004/0087475 | A1 | 5/2004 | Jonke et al. | |
| 2005/0170994 | A1 | 8/2005 | Casado-Dominguez et al. | |

FOREIGN PATENT DOCUMENTS

| | | | |
|---|---|---|---|
| EP | 0018039 | A1 | 10/1980 |
| EP | 0088520 | A2 | 9/1983 |
| EP | 0122140 | A2 | 10/1984 |
| EP | 0239910 | A2 | 10/1987 |
| EP | 0415698 | A2 | 3/1991 |
| EP | 0458599 | A2 | 11/1991 |
| EP | 0460683 | A2 | 12/1991 |
| EP | 0463431 | A2 | 1/1992 |
| EP | 1447423 | A1 | 8/2004 |
| FR | 2318268 | A1 | 2/1977 |
| GB | 1596792 | | 8/1981 |
| WO | WO 9201776 | A1 | 2/1992 |
| WO | WO 9524460 | A1 | 9/1995 |
| WO | WO 9731997 | A1 | 9/1997 |
| WO | WO 9731998 | A1 | 9/1997 |
| WO | WO 0196510 | A1 | 12/2001 |
| WO | WO 0242360 | A2 | 5/2002 |
| WO | WO 03022969 | A1 | 3/2003 |
| WO | WO 2004069899 | A1 | 8/2004 |
| WO | WO 2005042829 | A1 | 5/2005 |

OTHER PUBLICATIONS

PCT International Search Report for PCT/EP2007/060552 dated Dec. 7, 2007, 5 pages.

English language abstract for FR 2318268 extracted from espacenet.com database dated Sep. 15, 2009, 37 pages.

* cited by examiner

*Primary Examiner* — John Hardee

(74) *Attorney, Agent, or Firm* — Howard & Howard Attorneys PLLC

(57) ABSTRACT

A process is disclosed for preparing a fabric softener composition containing a quaternary ammonium salt, and a silicone or organic oil. The process involves forming a thick phase aqueous dispersion of the quaternary ammonium salt with the silicone or organic oil, and further admixing additional water to form a fabric softener composition.

5 Claims, No Drawings

PROCESS FOR PREPARING FABRIC SOFTENER COMPOSITIONS

RELATED APPLICATIONS

This application claims priority to and all the advantages of International Patent Application No. PCT/EP2007/060552, filed on Oct. 4, 2007, which claims priority to U.S. Provisional Patent Application No. 60/850,224, filed on Oct. 6, 2006.

This invention relates to a process for preparing a fabric softener composition containing a quaternary ammonium salt, and a silicone or organic oil.

Fabric softener compositions, especially those added in the rinse stage of fabric cleaning or laundry process, are well known in the art. It is also known to incorporate one or more additional materials such as silicones or polydiorganosiloxanes, to reduce wrinkling of the fabric during the rinsing and drying stages, to reduce the appearance of wrinkles or creases before ironing, to make ironing easier, to bring high fabric softening performances or to improve fabric rewettability as described in the patents WO9524460, FR7621830, GB1596792, U.S. Pat. No. 4,426,299, U.S. Pat. No. 4,806,255, GB0239910, U.S. Pat. No. 4,855,072.

Fabric softening compositions are classically composed of polyalkyl quaternary ammonium salts and more specifically of ester-linked quaternary ammonium fabric softening materials having one or more fully saturated alkyl chains. Because of their structure and their low solubility, these surfactants have poor emulsification features. Thus, the addition of an oil, especially a silicone oil, to the fabric softener composition is very difficult due to coalescence of particles leading to product instability.

In order to reduce the stability issues due to the in situ emulsification of the silicone, many prior art compositions, describe the silicone incorporation in the form of a ready to use micro-emulsion, that is to say the silicone is present as liquid droplets having a droplet size less than the wavelength of visible light and so the emulsion is substantially transparent see for example the patent WO92/01776. However, in a few cases, macro-emulsions are used (e.g. WO-A-97/31997 and '98). In these inventions the silicones is already emulsified before addition to the fabric softener formulation. For instance the patent WO-A-95/24460 discloses a fabric softening composition which contains from about 0.2% to about 20% of a polydimethyl siloxane having a viscosity from about 2 to 5,000 centi-Stokes (cSt). The silicone herein is either a polydimethyl siloxane (polydimethyl silicone or PDMS), or a derivative thereof, 'e.g., amino silicones, ethoxylated silicones, etc. Using this procedure high viscosity pre-emulsified silicones can also be incorporated in the fabric softener.

U.S. Pat. No. 6,251,850 shows that good anti-creasing and/or ease of ironing can be achieved by formulating a fabric softener in which a silicone is incorporated in the form of a macro-emulsion and which silicone has a viscosity of from 10,000 cSt to 1,000,000 cSt, and/or the emulsified silicone has a median droplet size of at least 0.2 μm and is emulsified with at least one cationic surfactant.

US2001/0006937 describes a processing method whereby an oily sugar derivative is emulsified separately from the cationic fabric softening compound having two or more alkyl or alkenyl chains. The inventors explain that using this procedure they were able to get emulsions with good stability.

WO2005/042829 describes the pre-emulsification of an amino silicone with cationic surfactant and its addition to the fabric softener.

The use of emulsion technologies to disperse softening oils like silicones in to fabric care formulations may be expensive due to their high cost per active weight. Another interest in being able to formulate silicone emulsion in situ is to develop concentrated fabric softener formulations containing both high level of ester-quat and silicone oil with no extra-addition of water coming from the emulsion itself.

WO01/96510 describes in situ emulsified organic oil to both get softening and perfume benefits. However the process described in this invention is either based on mixing the oil to the water phase and prepare the emulsion or to mix the emulsion together with the quat and a non-ionic surfactant to molten and add this mixture to hot water.

EP 0460683 A2 and EP 0463431 A2 describe formulations obtained by forming a thick phase emulsion from a polysiloxane, at least one primary nonionic surfactant and water. After that first dispersion, at least one secondary surfactant, which may be a quaternary ammonium salt, is added.

WO 02/42360 A explains that silicone in water emulsions can be produced by emulsion polymerisation or by mechanical emulsification of a silicone polymer with one or more surfactants and water. Because silicones are highly hydrophobic, stable emulsions are difficult to produce mechanically and it is generally necessary to mix the silicone with a surfactant and a small amount of water under high mechanical shear to form a non-Newtonian "thick phase", which has a very high viscosity at low shear rates (much more viscous at low shear rate than the silicone polymer alone) and often exhibits a yield stress (viscoplastic behaviour). The resulting emulsion can be diluted with further water and surfactant. The highly viscous nature of this "thick phase" emulsion leads to a risk of uneven mixing or localised overheating when the process is carried out batchwise on an industrial scale. Therefore in the process of the invention according to WO 02/42360 for the production of a silicone in water emulsion, the polysiloxane fluid, at least one surfactant and water are continuously fed to a high shear mixer in such proportions to form a viscous oil in water emulsion which is continuously withdrawn from the mixer. The polysiloxane content of the mixture fed to the high shear mixer is typically comprised between 70 and 90% by weight.

Example 1 of WO 2004/069899 describes using such high shear mixer to form a thick phase emulsion of a polydimethylsiloxane with a nonionic surfactant and water. The resulting thick phase emulsion is then diluted with water and a quaternary ammonium salt surfactant is added.

Hence, there is a need to emulsify silicone polymers while preparing the fabric conditioner in order to improve the overall economics of the formula while maintaining the typical fabric care benefits of silicones like fast drying, ease of ironing etc and fabric softener product handling properties like viscosity and stability. The formed emulsion has to be stable to prevent both creaming and coalescence that are detrimental for the product stability.

The present inventors have now found that silicone or organic oils of various viscosities and containing various functionalities can effectively be emulsified while processing the fabric softener. The process involves forming a thick phase aqueous dispersion of the quaternary ammonium salt with the silicone or organic oil, and further admixing additional water to form a fabric softener composition. The fabric softener compositions produced by this inventive method may provide formulations containing emulsion of silicones with low particle size distribution and where no coalescence or other types of instabilities are observed. The process permits to efficiently emulsify a silicone polymer while processing at the same time the fabric softener so as to obtain a fully formulated fabric softener containing the in situ emulsified polymer in one stage process. No post stage of adding the silicone emulsion to the fabric softener dispersion is needed. The product obtained can be handled as a concentrated version of fabric softener, easy to store and transport which can be diluted afterwards, just before use or final conditioning, by adding water.

SUMMARY

This invention provides a process for preparing a fabric softener composition comprising:

I) mixing;

25 to 55 wt % A) a quaternary ammonium salt, 1 to 20 wt % B) a silicone or organic oil, 0 to 4 wt % C) a nonionic surfactant, and sufficient water to total 100 wt % of the components, to form a thick phase dispersion, II) dmixing additional water to the thick phase dispersion to form the fabric softener composition.

The present invention is also directed to the fabric softener compositions prepared according to the inventive process.

DETAILED DESCRIPTION

The first step in the process for preparing a fabric softener composition of the present invention is mixing;

25 to 55 wt % A) a quaternary ammonium salt, 1 to 20 wt % B) a silicone or organic oil, 0 to 4 wt % C) a nonionic surfactant, and sufficient water to total 100 wt % of the components, to form a thick phase dispersion.

A) The Quaternary Ammonium Salt

Any conventional fabric conditioning agent may be used in the compositions of the present invention. The conditioning agents may be cationic or non-ionic. If the fabric conditioning compound is to be employed in a main wash detergent composition the compound will typically be non-ionic. For use in the rinse phase, typically they will be cationic.

Suitable cationic fabric softening compounds are substantially water-insoluble quaternary ammonium materials comprising a single alkyl or alkenyl long chain having an average chain length greater than or equal to $C_{20}$ or, more preferably, compounds comprising a polar head group and two alkyl or alkenyl chains having an average chain length greater than or equal to $C_{14}$. Preferably the fabric softening compounds have two long chain alkyl or alkenyl chains each having an average chain length greater than or equal to $C_{16}$. Most preferably at least 50% of the long chain alkyl or alkenyl groups have a chain length of $C_{18}$ or above. It is preferred if the long chain alkyl or alkenyl groups of the fabric softening compound are predominantly linear.

Quaternary ammonium compounds having two long-chain aliphatic groups, for example, distearyldimethyl ammonium chloride and di(hardened tallow alkyl) dimethyl ammonium chloride, are widely used in commercially available rinse conditioner compositions The fabric softening compounds are preferably compounds that provide excellent softening, and are characterised by a chain melting Lβ to Lα transition temperature greater than 25° C., preferably greater than 35° C., most preferably greater than 45° C.

Substantially water-insoluble fabric softening compounds are defined as fabric softening compounds having a solubility of less than $1\times10^{-3}$wt % in demineralised water at 20° C. Preferably the fabric softening compounds have a solubility of less than $1\times10^{-4}$wt %, more preferably less than $1\times10^{-8}$to $1\times10^{-6}$wt %.

Especially preferred are cationic fabric softening compounds that are water-insoluble quaternary ammonium materials having two $C_{12-22}$ alkyl or alkenyl groups connected to the molecule via at least one ester link, preferably two ester links. An especially preferred ester-linked quaternary ammonium material can be represented by the formula:

$$R_5—N^+(—R_5)[—(CH_2)_p\text{-}T\text{-}R_6]—R_7\text{-}T\text{-}R_6$$

wherein each $R_5$ group is independently selected from $C_{1-4}$ alkyl or hydroxyalkyl groups or $C_{2-4}$ alkenyl groups; each $R_6$ group is independently selected from $C_{8-28}$ alkyl or alkenyl groups; and wherein $R_7$ is a linear or branched alkylene group of 1 to 5 carbon atoms, T is $$—C(=O)—O— \text{ or } —O—C(=O)—$$

and p is 0 or is an integer from 1 to 5.

Di(tallowoxyloxyethyl) dimethyl ammonium chloride and/or its hardened tallow analogue is an especially preferred compound of this formula.

A second preferred type of quaternary ammonium material can be represented by the formula:

$$(R_5)_3N^+—(CH_2)—CH(—OOCR_6)(—CH_2OCR_6)$$

wherein $R_5$, p and $R_6$ are as defined above.

A third preferred type of quaternary ammonium material are those derived from triethanolamine (hereinafter referred to as 'TEA quats') as described in for example U.S. Pat. No. 3,915,867 and represented by formula: $(TOCH_2CH_2)_3N+(R_9)$ wherein T is H or ($R_8$—CO—) where $R_8$ group is independently selected from $C_{8-28}$ alkyl or alkenyl groups and $R_9$ is $C_{1-4}$ alkyl or hydroxyalkyl groups or $C_{2-4}$ alkenyl groups. For example N-methyl-N,N,N-triethanolamine ditallowester or di-hardened-tallowester quaternary ammonium chloride or methosulphate. Examples of commercially available TEA quats include Rewoquat WE18 and Rewoquat WE20, both partially unsaturated (ex. WITCO), Tetranyl AOT-1, fully saturated (ex. KAO) and Stepantex VP 85, fully saturated (ex. Stepan).

It is advantageous if the quaternary ammonium material is biologically biodegradable. Preferred materials of this class such as 1,2-bis(hardened tallowoyloxy)-3-trimethylammonium propane chloride and their methods of preparation are, for example, described in U.S. Pat. No. 4,137,180 (Lever Brothers Co). Preferably these materials comprise small amounts of the corresponding monoester as described in U.S. Pat. No. 4,137,180, for example, 1-hardened tallowoyloxy-2-hydroxy-3-trimethylammonium propane chloride. Suitable cationic fabric softening materials are described in U.S. Pat. No. 7,026,277.

Component A) in step I of the present inventive process is preferably one or more quaternary ammonium salt. Typically, the quaternary ammonium salt has at least two long chains, that is a component containing at least two alkyl or alkenyl chains, each comprising from 10 to 25 carbon atoms.

Component A) may be selected from any quaternary ammonium salt useful as a fabric softener. Typically, such quaternary ammonium salts are those containing at least two "fatty" or long chain alkyl groups. Representative, non-limiting examples of quaternary ammonium salt having at least two long chains useful as component A) in the present process includes:

ditallow dimethylammonium chloride (DTDMAC);

dihydrogenated tallow dimethylammonium chloride;

dihydrogenated tallow dimethylammonium methylsulfate;

distearyl dimethylammonium chloride;
dioleyl dimethylammonium chloride;
dipalmityl hydroxyethyl methylammonium chloride;
stearyl benzyl dimethylammonium chloride;
tallow trimethylammonium chloride;
hydrogenated tallow trimethylammonium chloride;
C 12-14 alkyl hydroxyethyl dimethylammonium chloride;
C 12-18 alkyl dihydroxyethyl methylammonium chloride;
ditallow imidazolinium methylsulfate;
1-(2-tallowyca midoethyl)-2-tallowyl imidazolinium methylsulfate.
N,N-di(tallowyl-oxy-ethyl)-N,N-dimethyl ammonium chloride;
N,N-di(canolyl-oxy-ethyl)-N,N-dimethyl ammonium chloride;
N,N-di(tallowyl-oxy-ethyl)-N-methyl, N-(2-hydroxyethyl) ammonium chloride;
N,N-di(canolyl-oxy-ethyl)-N-methyl, N-(2-hydroxyethyl) ammonium chloride;
N,N-di(2-tallowyloxy-2-oxo-ethyl)-N,N-dimethyl ammonium chloride;
N,N-di(2-canolyloxy-2-oxo-ethyl)-N,N-dimethyl ammonium chloride,
N,N-di(2-tallowyloxyethylcarbonyloxyethyl)-N,N-dimethyl ammonium chloride;
N,N-di(2-canolyloxyethylcarbonyloxyethyl)-N,N-dimethyl ammonium chloride;
N-(2-tallowoyloxy-2-ethyl)-N-(2-tallowyloxy-2-oxo-ethyl)-N,N-dimethyl ammonium chloride;
N-(2-canolyloxy-2-ethyl)-N-(2-canolyloxy-2-oxo-ethyl)-N,N-dimethyl ammonium chloride;
N,N,N-tri(tallowyl-oxy-ethyl)-N-methyl ammonium chloride;
N,N,N-tricanolyl-oxy-ethyl)-N-methyl ammonium chloride;
N-(2-tallowyloxy-2-oxoethyl)-N-(tallowyl)-N,N-dimethyl ammonium chloride;
N-(2-canolyloxy-2-oxoethyl)-N-(canolyl)-N,N-dimethyl ammonium chloride;
1,2-ditallowyloxy-3-N,N,N-trimethylammoniopropane chloride; and
1,2-dicanolyloxy-3-N,N,N-trimethylammoniopropane chloride;
and mixtures of the above.

B) The Silicone or Organic Oil

Component B) is a silicone or organic oil. In one preferred embodiment, component B) is a silicone compound. The silicone oil can be any organopolysiloxane. Organopolysiloxanes are polymers containing siloxane units independently selected from ($R_3SiO_{0.5}$), ($R_2SiO$), ($RSiO_{1.5}$), or ($SiO_2$) siloxy units, where R may be any monovalent organic group. These siloxy units may be combined in various manners to form cyclic, linear, or branched structures. When R is a methyl group in the ($R_3SiO_{0.5}$), ($R_2SiO$), ($RSiO_{1.5}$), or ($SiO_2$) siloxy units of an organopolysiloxane, the siloxy units are commonly referred to as M, D, T, and Q units respectively. The chemical and physical properties of the resulting polymeric structures can vary. For example organopolysiloxanes can be volatile or low viscosity fluids, high viscosity fluids/gums, elastomers or rubbers, and resins depending on the number and arrangement of the siloxy units in the organopolysiloxane.

The organopolysiloxanes useful as component B) in the present invention may contain any number or combination of ($R_3SiO_{0.5}$), ($R_2SiO$), ($RSiO_{1.5}$), or ($SiO_2$) siloxy units. Component B) may also be a mixture of two or more organopolysiloxanes. The organopolysiloxane may be selected, but limited to, those known in the art as silicone fluids, gums, elastomers or resins. The organopolysiloxane may also be selected, but limited to, those known in the art as "organofunctional" silicone fluids, gums, elastomers or resins. Component A) may be selected from those organopolysiloxanes known in the art to improve softening or "hand" of textiles or fabric surfaces.

In one embodiment of the present invention, herein referred to as the "dimethyl silicone" embodiment, the organopolysiloxane is selected from a polydimethylsiloxane having a viscosity greater than 1000 $mm^2/s$ at 25° C., alternatively having a viscosity greater than 10,000 $mm^2/s$ at 25° C., alternatively having a viscosity greater than 100,000 $mm^2/s$ at 25° C. The "endblocking" group of the polydimethylsiloxane is not critical, and typically is either OH (i.e. SiOH terminated), alkoxy (RO), or trimethylsiloxy ($Me_3SiO$).

The organopolysiloxane may also be a mixture of various polydimethylsiloxanes of varying viscosities or molecular weights. Furthermore, the organopolysiloxane may also be a mixture of a high molecular weight organopolysiloxane, such as a gum, resin, or elastomer in a low molecular weight or volatile organopolysiloxane. The polydimethylsiloxane gums suitable for the present invention are essentially composed of dimethylsiloxane units with the other units being represented by monomethylsiloxane, trimethylsiloxane, methylvinylsiloxane, methylethylsiloxane, diethylsiloxane, methylphenylsiloxane, diphenylsiloxane, ethylphenylsiloxane, vinylethylsiloxane, phenylvinylsiloxane, 3,3,3-trifluoropropylmethylsiloxane, dimethylphenylsiloxane, methylphenylvinylsiloxane, dimethylethylsiloxane, 3,3,3-trifluoropropyldimethylsiloxane, mono-3,3,3-trifluoropropylsiloxane, aminoalkylsiloxane, monophenylsiloxane, monovinylsiloxane and the like.

Representative, non-limiting examples of commercially available organopolysiloxanes useful as component B) include, DOW CORNING 200® fluids of varying viscosities, and DC3431 fluid (Dow Corning Corporation, Midland, Mich.).

In an alternative embodiment, the organopolysiloxane may be selected from any "organofunctional" silicone, known in the art for enhancing softening or feel of fabrics. For example, those organofunctional silicones known as amino, amido, epoxy, mercapto, polyether, functional, or modified, silicones may be used as component B).

The organofunctional organopolysiloxanes of the present invention are characterized by having at least one of the R groups in the formula $R_nSiO_{(4-n)/2}$ be an organofunctional group. Representative non-limiting organofunctional groups include; amino, amido, epoxy, mercapto, polyether (polyoxyalkylene) groups, and any mixture thereof. The organofunctional group may be present on any siloxy unit having an R substituent, that is, they may be present on any ($R_3SiO_{0.5}$), ($R_2SiO$), or ($RSiO_{1.5}$) unit.

Amino-functional groups may be designated in the formulas herein as $R^N$ and is illustrated by groups having the formula; $—R^1NHR^2$, $—R^1NR_2{}^2$, or $—R^1NHR^1NHR^2$, wherein each $R^1$ is independently a divalent hydrocarbon group having at least 2 carbon atoms, and $R^2$ is hydrogen or an alkyl group. Each $R^1$ is typically an alkylene group having from 2 to 20 carbon atoms. $R^1$ is illustrated by groups such as; $—CH_2CH_2—$, $—CH_2CH_2CH_2—$, $—CH_2CHCH_3—$, $—CH_2CH_2CH_2CH_2—$, $—CH_2CH(CH_3)CH_2—$, $—CH_2CH_2CH_2CH_2CH_2CH_2—$, $—CH_2CH_2CH_2CH_2CH_2CH_2—$, $—CH_2CH_2CH(CH_2CH_3)CH_2CH_2CH_2—$, $—CH_2CH_2CH_2CH_2CH_2CH_2CH_2CH_2—$, and $—CH_2CH_2CH_2CH_2CH_2CH_2CH_2CH_2—$. The alkyl groups $R^2$ are as illustrated above for R. When $R^2$ is an alkyl group, it is typically methyl.

Some examples of suitable amino-functional hydrocarbon groups are; —$CH_2CH_2NH_2$, —$CH_2CH_2CH_2NH_2$, —$CH_2CHCH_3$ NH, —$CH_2CH_2CH_2CH_2NH_2$, —$CH_2CH_2CH_2CH_2CH_2NH_2$, —$CH_2CH_2CH_2CH_2CH_2CH_2NH_2$, —$CH_2CH_2NHCH_3$, —$CH_2CH_2CH_2NHCH_3$, —$CH_2(CH_3)CHCH_2NHCH_3$, —$CH_2CH_2CH_2CH_2NHCH_3$, —$CH_2CH_2NHCH_2CH_2NH_2$, —$CH_2CH_2CH_2NHCH_2CH_2NH_2$, —$CH_2CH_2CH_2CH_2NHCH_2CH_2CH_2NH_2$, —$CH_2CH_2NHCH_2CH_2NHCH_3$, —$CH_2CH_2CH_2NHCH_2CH_2CH_2NHCH_3$, —$CH_2CH_2CH_2CH_2NHCH_2CH_2CH_2CH_2NHCH_3$, and —$CH_2CH_2NHCH_2CH_2NHCH_2CH_2CH_2CH_3$.

In another embodiment, component B) is an organic oil. When component B) is an organic oil, it may be selected from any organic oil known in the art suitable for use in the preparation of fabric care formulations. Suitable organic oils include, but are not limited to, natural oils such as coconut oil; hydrocarbons such as mineral oil and hydrogenated polyisobutene; fatty alcohols such as octyldodecanol; esters such as C12 -C15 alkyl benzoate; diesters such as propylene dipelarganate; and triesters, such as glyceryl trioctanoate. The organic oil components can also be mixture of low viscosity and high viscosity oils. Suitable low viscosity oils have a viscosity of 5 to 100 mPa·s at 25° C., and are generally esters having the structure RCO—OR' wherein RCO represents the carboxylic acid radical and wherein OR' is an alcohol residue. Examples of these low viscosity oils include isotridecyl isononanoate, PEG-4 diheptanoate, isostearyl neopentanoate, tridecyl neopentanoate, cetyl octanoate, cetyl palmitate, cetyl ricinoleate, cetyl stearate, cetyl myristate, cocodicaprylate/caprate, decyl isostearate, isodecyl oleate, isodecyl neopentanoate, isohexyl neopentanoate, octyl palmitate, dioctyl malate, tridecyl octanoate, myristyl myristate, octododecanol, or mixtures of octyldodecanol, acetylated lanolin alcohol, cetyl acetate, isododecanol, polyglyceryl-3-diisostearate, or mixtures thereof. The high viscosity surface oils generally have a viscosity of 200-1,000,000 mPa·s at 25° C., preferably a viscosity of 100,000-250,000 mPa·s. Surface oils include castor oil, lanolin and lanolin derivatives, triisocetyl citrate, sorbitan sesquioleate, C10-18 triglycerides, caprylic/capric/triglycerides, coconut oil, corn oil, cottonseed oil, glyceryl triacetyl hydroxystearate, glyceryl triacetyl ricinoleate, glyceryl trioctanoate, hydrogenated castor oil, linseed oil, mink oil, olive oil, palm oil, illipe butter, rapeseed oil, soybean oil, sunflower seed oil, tallow, tricaprin, trihydroxystearin, triisostearin, trilaurin, trilinolein, trimyristin, triolein, tripalmitin, tristearin, walnut oil, wheat germ oil, cholesterol, or mixtures thereof. Mention may be made, among the optional other non-silicone fatty substances, of mineral oils, such as liquid paraffin or liquid petroleum, of animal oils, such as perhydrosqualene or arara oil, or alternatively of vegetable oils, such as sweet almond, calophyllum, palm, castor, avocado, jojaba, olive or cereal germ oil. It is also possible to use esters of lanolic acid, of oleic acid, of lauric acid, of stearic acid or of myristic acid, for example; alcohols, such as oleyl alcohol, linoleyl or linolenyl alcohol, isostearyl alcohol or octyldodecanol; or acetylglycerides, octanoates, decanoates or ricinoleates of alcohols or of polyalcohols. It is alternatively possible to use hydrogenated oils which are solid at 25° C., such as hydrogenated castor, palm or coconut oils, or hydrogenated tallow; mono-, di-, tri- or sucroglycerides; lanolins; or fatty esters which are solid at 25° C.

C) The Nonionic Surfactant

A non ionic surfactant (surface active agent) is preferably present in the composition. More preferably, the surfactant is incorporated at a level of from about 0.01% to about 5%, preferably from about 0.03% to about 4% by weight of the thick phase dispersion. Examples of nonionic surfactants include condensates of ethylene oxide with long chain fatty alcohols or fatty acids such as a C12-16 alcohol, condensates of ethylene oxide with an amine or an amide, condensation products of ethylene and propylene oxide, esters of glycerol, sucrose, sorbitol, fatty acid alkylol amides, sucrose esters, fluoro-surfactants, fatty amine oxides, polyoxyalkylene alkyl ethers such as polyethylene glycol long chain (12-14C) alkyl ether, polyoxyalkylene sorbitan ethers, polyoxyalkylene alkoxylate esters, polyoxyalkylene alkylphenol ethers, ethylene glycol propylene glycol copolymers and alkylpolysaccharides, for example materials of the structure $R^1$—O—$(R^2O)_m$-$(G)_n$ wherein $R^1$ represents a linear or branched alkyl group, a linear or branched alkenyl group or an alkylphenyl group, $R^2$ represent an alkylene group, G represents a reduced sugar, m denotes 0 or a positive integer and n represent a positive integer as described in U.S. Pat. No. 5,035,832. non ionic surfactants additionally include polymeric surfactants such as polyvinyl alcohol (PVA) and polyvinylmethylether.

Representative examples of suitable commercially available nonionic surfactants include polyoxyethylene fatty alcohols sold under the tradename BRIJ by Uniqema (ICI Surfactants), Wilmington, Del. Some examples are BRIJ 35 Liquid, an ethoxylated alcohol known as polyoxyethylene (23) lauryl ether, and BRIJ 30, another ethoxylated alcohol known as polyoxyethylene (4) lauryl ether. Some additional nonionic surfactants include ethoxylated alcohols sold under the trademark TERGITOL® by The Dow Chemical Company, Midland, Mich. Some example are TERGITOL® TMN-6, an ethoxylated alcohol known as ethoxylated trimethylnonanol; and various of the ethoxylated alcohols, i.e., C12-C14 secondary alcohol ethoxylates, sold under the trademarks TERGITOL® 15-S-5, TERGITOL® 15-S-12, TERGITOL® 15-S-15, and TERGITOL® 15-S-40. Surfactants containing silicon atoms can also be used.

D) Inorganic Salt

Electrolyte component is an optional, but preferred, additive for compositions of the present invention. Electrolyte is especially preferred in compositions comprising at least 10% fabric softening active, by weight. Electrolyte is preferably included in compositions to modify the viscosity/elasticity profile of the composition on dilution and to provide lower viscosity and/or elasticity to the composition itself, or lower viscosity upon dilution. Suitable electrolytes for incorporation in the present compositions include inorganic salts.

Therefore, optional component D) is an inorganic salt, and may be selected from any inorganic salt known in the art for addition to fabric softener compositions. Non-limiting examples of suitable inorganic salts include: MgI2, MgBr2, MgCl2, Mg(N03) 2, Mg3 (PO4) 2, Mg2P207, MgS04, magnesium silicate, NaI, NaBr, NaCl, NaF, Na3(PO4), NaS03, Na2S04, Na2S03, NaN03, NaI03, Na3 (PO4), Na4P207, sodium silicate, sodium metasilicate, sodium tetrachloroaluminate, sodium tripolyphosphate (STPP), Na2Si307, sodium zirconate, CaF2, CaCl2, CaBr2, CaI2, CaS04, Ca(N03)2, Ca, KI, KBr, KC1, KF, KN03, KIO3, K2SO4, K2SO3, K3(PO4), K4(P207), potassium pyrosulfate, potassium pyrosulfite, LiI, LiBr, LiCl, LiF, LiNO3, A1F3, AlCl3, AlBr3, AlIs, A12(SO4) 3, A1(PO4), A1(NO3) 3, aluminum silicate; including hydrates of these salts and including combinations of these salts or salts with mixed cations e. g. potassium alum AlK (SO4) 2 and salts with mixed anions, e. g. potassium tetrachloroaluminate and sodium tetrafluoroaluminate. Salts incorporating cations from groups IIIa, IVa, Va, VIa, VIIa, VIII, Ib, and IIb on the periodic chart with atomic numbers >13 are also useful in reducing dilution viscosity but less preferred due to their tendency to change oxidation states and thus they can adversely affect the odor or color of the formulation or lower weight efficiency. Salts with cations from group Ia or IIa with atomic numbers >20 as well as salts with cations from the lactinide or actinide series are useful in reducing dilution viscosity, but less preferred. Mixtures of above salts are also useful.

Typically, the inorganic salt contains a group I or group II metal and a halide, such as a chloride, bromide, or iodide. Most commonly, the inorganic salt is magnesium chloride. The inorganic salt, when used, is added to provide 0.05 to 5 weight percent, or from 0.1 to 2 weight percent of the fabric softener composition.

To form the thick phase in step I, 25 to 55 wt % of components A), 1 to 20 wt % component B), 0 to 4 wt % component C) and D) are combined with sufficient water to total 100 wt %. The order of mixing in step I is not critical. Typically, the components are mixed at a temperature above the melt point of the quaternary ammonium salt. Alternatively, the temperature of step I may range from 40 to 100° C., or alternatively from 50 to 70° C. In a typical procedure, the quaternary ammonium salt is first melted, and then mixed with the organopolysiloxane and nonionic surfactant (when used). Water may then be added. Mixing can be effective with conventional stirring techniques and can occur in either a batch or continuous process. Mixing may also be effected by conventional emulsification equipments as rotor-stator, colloid mills, homogenizers, and sonolaters.

Step II of the inventive process involves admixing additional water to the thick phase dispersion formed in step I to form the fabric softener composition. Typically, the additional water added is heated to a similar temperature as the thick phase. Thus, the water is admixed at a temperature of 40 to 100° C., alternatively from 50 to 70° C. The quantity of water may vary, but typically the amount of additional water admixed to the thick phase is such to provide from a 0.5 to 2 weight ratio of water to thick phase, alternatively from 0.75 to 1.5. The additional water may be admixed at once, but typically, the additional water is added in a controlled manner to ensure the added water fully disperses within the thick phase. In other words, a stable dispersion should be maintained. The additional water may also be added in "stages", that is in varying quantities over a given time period. Upon adding the water, mixing can be effective with conventional stirring techniques and can occur in either a batch or continuous process.

Upon forming the fabric softener composition, additional mixing may optionally be used to further improve shelf storage and/or reduce particle size. Such mixing is effected by conventional emulsification equipments as rotor-stator, colloid mills, homogenizers, and sonolaters.

Additional Components

The fabric softener compositions of the present invention may also contain additional optional components such as enzymes, additional fabric softener materials, surfactant concentration aids, electrolyte concentration aids, stabilizers, such as well-known antioxidants and reductive agents, soil release polymers, emulsifiers, bactericides, colorants, perfumes, preservatives, optical brighteners, anti-ionization agents, antifoam agents and chelating agents.

In fabric softening compositions nonionic stabilising agent may be present. Suitable nonionic stabilising agents may be present such as linear $C_8$ to $C_{22}$ alcohols alkoxylated with 10 to 20 moles of alkylene oxide, $C_{10}$ to $C_{20}$ alcohols, or mixtures thereof. Other stabilising agents include the deflocculating polymers as described in EP 0415698A2 and EP 0458599 B1.

EXAMPLES

These examples are intended to illustrate the invention to one of ordinary skill in the art and should not be interpreted as limiting the scope of the invention set forth in the claims. All measurements and experiments were conducted at 23° C., unless indicated otherwise.

Materials

Quat=quaternary ammonium salt Tetranyl L1/90 from Kao

Nonionic 1=nonionic surfactant, Volpo T7/85, from CRODA

Nonionic 2=Tween 20 from ICI

Dimethyl silicone=DC 3431 (Dow Corning Corporation, Midland Mich.), hydroxy terminated polydimethylsiloxane having a viscosity of 13,500 $mm^2/s$ at 25° C.

Amino silicone=DC-8500 (Dow Corning Corporation, Midland Mich.),

Amido silicone=DC-8813 (Dow Corning Corporation, Midland Mich.)

Example 1

A Quat (16.6 g), a nonionic 1 surfactant (1 g) and Dimethyl silicone (5 g) were mixed together at 150 rpm at 55° C. Water (30 g) was added to form a thick phase dispersion. Then, under stirring, hot water (46.6 g) was added to the top of the gel phase. The gel dispersed and a liquid fabric softener composition was obtained. The resulting composition was sheared using a high shear mixer (ULTRATURAX for 10 s at 8000 rpm) to further disperse the thick phase. The system was then cooled to 30° C. while stirring at 150 rpm. A salt solution (0.8 g of a 20% solution of $MgCl_2(6H_2O)$) was then added and stirred for 15 min at 150 rpm. The final composition contained 16% Quat, 5% Dimethyl silicone, 1% nonionic 1 surfactant, and 0.8% salt solution. The resulting composition was stable for 12 weeks at room temperature.

Example 2

The process described in Example 1 was used to prepare a fabric softener composition containing an amino silicone. A thick phase was formed by mixing the Quat (41.5 g); water (41.5 g), nonionic 2 (2.5 g) and the amino silicone (12.5 g) at 150 rpm for 15 min at 55° C. Then cold water (76 g for each step) was added in 2 steps with stirring for 15 minutes at 150 rpm at 55° C. after each step. Then the liquid phase was passed through a high shear mixer (Rannie, 200 bars) and stirred for an additional 15 minutes at 150 rpm and 55° C. The system was then cooled to 30° C. for 15 min, 150 rpm. The salt solution was then added (15 min-150 rpm)

The final composition contained the following: 16% quat, 5% amino silicone, 1% nonionic surfactant 2, and 0.8% salt solution. The resulting composition was stable at room temperate after 12 weeks of storage, and for 2 weeks at 40° C.

Example 3

The process described in Example 1 was used to prepare a fabric softener composition containing an amino silicone. A thick phase was formed by mixing the Quat (41.5 g); water (41.5 g), nonionic 2 (2.5 g) and the amino silicone (12.5 g) at 150 rpm for 15 min at 55° C. Then cold water (76 g for each step) was added in 2 steps with stirring for 15 minutes at 150 rpm at 55° C. after each step. Then the liquid phase was passed through a high shear mixer (ULTRATURAX, for 1 min at 8000 rpm) and stirred for an additional 15 minutes at 150 rpm and 55° C. The system was then cooled to 30° C. for 15 min, 150 rpm. The salt solution was then added (15 min-150 rpm). The final composition contained the following: 16% quat, 5% amino silicone, 1% nonionic surfactant 2, and 0.8% salt solution. The resulting composition was stable at room temperate after 8 weeks of storage, and for 4 weeks at 40° C.

Example 4

The process described in Example 1 was used to prepare a fabric softener composition containing an amido silicone. A thick phase was formed by mixing the Quat (41.5 g); water (17.7 g), nonionic 2 (1 g) and the amido silicone (3 g) at 150 rpm for 15 min at 55° C. Then cold water (30.3 g for each step) was added in 2 steps with stirring for 15 minutes at 150 rpm at 55° C. after each step. Then the liquid phase was passed through a high shear mixer (Ultraturax, for 1 min at 8000 rpm) and stirred for an additional 15 minutes at 150 rpm and 55° C. The system was then cooled to 30° C. for 15 min, 150 rpm. The salt solution was then added (15 min-150 rpm). The final composition contained the following: 16% quat, 3% amido silicone, 1% nonionic surfactant 2, and 0.8% salt solution. The resulting composition was stable at room temperate after 4 weeks of storage.

Example 5 (Comparative)

First, 77.6 g of water was heated in a flask to 55° C. Then, the Quat (16.6 g) was melted and added at 50 to 55° C. with dimethyl silicone (5 g) to the water. Temperature of the resulting mixture was maintained at 55 C and while mixing at 150 rpm for 15 minutes. The system was cooled (at a rate of ~−1° C./min) to 25-30° C. The salt solution was then added and the composition mixed for additional 15 minutes at 150 rpm. The final composition contained 16% quat, 5% dimethyl silicone, 0.8% salt solution. Oily streaks were immediately observed on the composition indicating conventional methods to prepare fabric softeners containing a quat and silicone do not provide stable compositions.

Example 6 (Comparative)

First, the Quat (16.6 g) and Dimethyl silicone (5 g) were mixed and heated to 55° C. at 150 rpm. Then water (16.6 g) was added with stirring for 15 minutes at 150 rpm. A thick phase dispersion was formed. In a second flask, the remaining water (71 g) was heated at 55° C. to which the thick phase dispersion was added and stirred for 15 minutes at 150 rpm. The system is then cooled 30° C. Finally the salt solution was added with mixing at 150 rpm. Final composition contained 16% Quat, 5% 3431, and 0.8% salt solution. Oily streaks were observed immediately on top of the composition indicated that fabric softener composition prepared using this process does not sufficiently emulsify and stabilize the silicone in a fabric softener composition.

Example 7

The Quat (33.2 g), an Amino silicone (10 g), and water (60 g) were mixed at 55° C. for 15 minutes to produce a thick phase dispersion. Then 94 g of cold water was slowly added to the system with stirring to disperse the thick phase further. The thick phase dispersion was then passed through a high shear mixer (ULTRATURAX, for 15 s at 8000 rpm). The resulting dispersion was cooled to 30° C. while stirring, and 0.8 g salt solution was added to the composition. The composition was stable.

Example 8

Using the fabric softener composition of example 4, the softening and fast drying properties of fabric softeners where the silicone has been in situ emulsified or post added in the form of an emulsion compared to conventional fabric softener were evaluated.

Fast Drying Properties

The amount of water left in the fabric after the wash/spin cycle directly correlates with a reduction of drying time/energy. To do so, we measure the weight of fabric load after full wash cycle and compared to initial weight to get the water pick-up level.

Table 1 below represents the water pick up level when amido-silicone is either post added to the fabric softener or in situ emulsified. It shows that when dosed at 3% active material gives similar result in terms of residual water level when compared to a simple fabric softener formulation to which an amido-silicone emulsion made out of the same polymer has been post added to the fabric softener.

TABLE 1

| | Conventional Fabric Softener without silicone | Fabric Softener with 3% active silicone post-added | Fabric Softener with 3% active silicone in-situ emulsified (exemple 4) |
|---|---|---|---|
| % residual water | 107.4 | 102 | 102.6 |

Without any fabric softener, the % of residual water is above 130.

Softening Performances

Panel testing on towel swatches is typically used to evaluate softening benefits. We consider 16 panelists and focus on paired comparison tests between a reference treatment based on a 16% active triethanolamine-based diesterquat softener and the same with the addition of a silicone additive. Table 2 below shows that a first evaluation at 3% active silicone gives the following results. In this test 3% of an amido-silicone has been either added in the form of an emulsion or emulsified within the fabric softener microstructure.

TABLE 2

| | Conventional Fabric Softener without silicone | Fabric Softener with 3% active silicone post-added | Fabric Softener with 3% active silicone in-situ emulsified (exemple 4) |
|---|---|---|---|
| Estimated softness (0 to 10 scale, with 10 being the best) | 5/10 | 6/10 | 7/10 |

Ease of Ironing Benefit

We consider 14 panelists and focus on comparison tests between a reference treatment based on a 16% active triethanolamine-based diesterquat softener and the same with the addition of a silicone additive. Table 3 below shows that a first evaluation at 3% active silicone gives the following results. In this test 3% of an amido-silicone has been either added in the form of an emulsion or emulsified within the fabric softener microstructure.

TABLE 3

| | Conventional Fabric Softener without silicone | Fabric Softener with 3% active silicone post-added | Fabric Softener with 3% active silicone in-situ emulsified (exemple 4) |
|---|---|---|---|
| Ease of ironing from 0 to 10, with 10 being the best) | 5/10 | 5.7/10 | 6.1/10 |

The amidosilicone presence gives some ease of ironing attributes, whether post-added as an emulsion or in situ emulsified.

Water Absorbency

The testing consisted of measuring the time needed for a piece of towel to fall to the bottom of a 1 liter beaker full of water. The results are presented in the Table 4 below.

TABLE 4

| | Conventional Fabric Softener without silicone | Fabric Softener with 3% active silicone post-added | Fabric Softener with 3% active silicone in-situ emulsified (exemple 4) |
|---|---|---|---|
| Time (seconds) | 535 | 46 | 183 |

This shows that the water absorbency of a fabric treated with a Fabric Softener doped with aminosilicone whether emulsified in situ or post added is very significantly improved as compared with a fabric treated with a Fabric Softener not containing silicone.

These examples show that the fabric softener has similar properties to the formulation that has been doped with the emulsion. In both cases the performances are better than the one of the conventional fabric softener.

The invention claimed is:

1. A process for preparing a fabric softener composition comprising:

I) mixing;

25 to 55 wt % A) a quaternary ammonium softening compound, 1 to 20 wt % B) a silicone or organic oil, 0 to 4 wt % C) a nonionic surfactant, and sufficient water to total 100 wt % of the components, to form a thick phase dispersion, II) admixing additional water to the thick phase dispersion to form the fabric softener composition, wherein the weight ratio of the additional water admixed to the thick phase dispersion is from 0.5 to 2.

2. The process of claim 1 wherein 0.05 to 5 wt % of D) an inorganic salt is added in step II).

3. The process of claim 1 wherein the silicone is a polydimethylsiloxane.

4. The process of claim 1 wherein the silicone is an amine functional organopolysiloxane.

5. The process of claim 1 further comprising step III) shearing the fabric softener composition.

* * * * *